United States Patent [19]

Kark

[11] Patent Number: 4,841,612

[45] Date of Patent: Jun. 27, 1989

[54] ROLL DEVICE COMPRISING A SHAFT AND AT LEAST ONE ROLL RING ARRANGED THEREON

[76] Inventor: Uwe Kark, Cuxhavener Strasse 60a, 2104 Hamburg 92, Fed. Rep. of Germany

[21] Appl. No.: 215,299

[22] Filed: Jul. 5, 1988

[30] Foreign Application Priority Data

May 27, 1988 [DE] Fed. Rep. of Germany ... 8806968[U]

[51] Int. Cl.[4] ..... B21B 31/00

[52] U.S. Cl. ..... 29/123; 29/125; 72/238

[58] Field of Search ..... 29/123, 125, 110; 72/237, 238, 199

[56] References Cited

U.S. PATENT DOCUMENTS 3,985,013 10/1976 Pillon et al. ..... 72/238
4,008,598 2/1977 Purcupile et al. .
4,099,311 7/1978 Kark ..... 29/125
4,117,705 10/1978 Dempsey .
4,208,147 6/1980 Giege et al. .
4,650,364 3/1987 Kark ..... 72/237
4,748,729 6/1988 Rochelmeyer ..... 29/123

FOREIGN PATENT DOCUMENTS 1948424 4/1970 Fed. Rep. of Germany .
127010 10/1985 Japan .

OTHER PUBLICATIONS

"A New Concept for Bar Mill Rolls", (Iron and Steel Engineers, vol. 55, No. 9, 1978.09).

*Primary Examiner*—Howard N. Goldberg
*Assistant Examiner*—Irene Cuda
*Attorney, Agent, or Firm*—Chilton, Alix & Van Kirk

[57] ABSTRACT

A roll device is made with roll rings clamped axially between a shaft collar and an adjustable ring stop. The ring stop comprises a ring which is fixed to the shaft and which can be designed, for example, as a threaded nut, and an adjusting ring. The ring fixed to the shaft and the adjusting ring interact via sawtooth-shaped end faces.

6 Claims, 1 Drawing Sheet

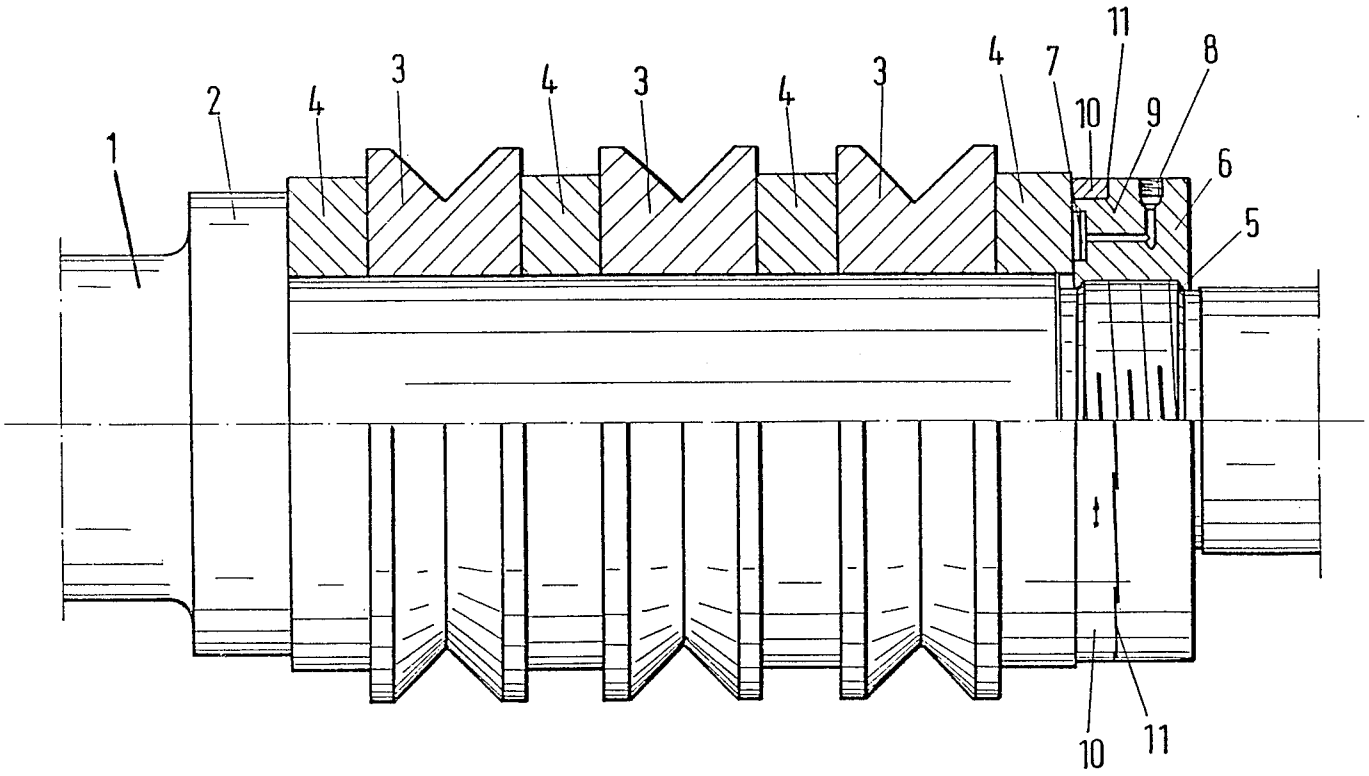
1
2
4
3
4
3
4
3
4
7
10
11
9
8
6
5
10
11

ROLL DEVICE COMPRISING A SHAFT AND AT LEAST ONE ROLL RING ARRANGED THEREON

BACKGROUND OF THE INVENTION

The invention relates to a roll device comprising a shaft, at least one roll ring arranged thereon, on one side of the roll ring a collar integral with the shaft, on the other side a ring stop adjustable and lockable on the shaft and intended for clamping the roll ring, and an hydraulic power clamping device for pre-stressing the roll ring before the ring stop is adjusted to the clamping position.

In a known roll device of this type (U.S. Pat. No. 4,208,147), the roll ring is clamped partially radially via a conical sleeve and partially axially via a strong annular spring, by means of a ring stop which is designed as a nut on a thread of the shaft. The nut acts on a ring which is arranged between the conical sleeve and the spring and which is also subjected to stress by a hydraulic power clamping device which is located on the shaft thread on the side of the nut facing away from the roll ring and the force of which has to be transmitted to the ring by means of a sleeve radially outside the nut. This arrangement involves a high outlay and occupies a large amount of space in the axial direction. Furthermore, it has disadvantages in that a nut, of which the number of supporting thread turns is limited, as is known, is used as an adjustable element of the ring stop.

SUMMARY OF THE INVENTION

The object on which the invention is based is to avoid the disadvantages mentioned. It achieves this because the adjustable ring stop comprises a ring fixed to the shaft and an adjusting ring which interact on their end faces with matching sloping faces distributed in a sawtooth-shaped manner over the circumference and having a small pitch in relation to the circumferential direction.

During the clamping of the roll ring or roll rings, the ring stop, of which the ring fixed to the shaft can be formed by a threaded nut on a shaft thread, is first adjusted as far as possible, its matching sawtooth-shaped faces being in the deepest possible engagement. The roll-ring arrangement is then tensioned by means of the hydraulic power clamping device. The adjusting ring is now rotated relative to the ring fixed to the shaft, until it is firmly up against the roll ring or an intermediate ring located between it and the roll ring. The hydraulic tension can then be released.

The arrangement is extremely simple, because the hydraulic power clamping device can be contained on or in the ring, fixed to the shaft, of the adjustable ring stop, specifically appropriately radially within the adjusting ring, so that the latter is accessible from outside directly and without the need for a force-transmitting sleeve. Since the power clamping device is incorporated in the adjustable ring stop, only a small amount of axial space is required. In contrast to a nut which, for a given load, has to be relatively large, the adjusting ring can transmit high axial forces even with small dimensions, because the entire bearing area of the matching sloping faces can be considered as providing support.

Since the ring fixed to the shaft and designed as a nut must have a considerable cross-sectional extent in view of the transmission of force to the shaft via the thread, not only the hydraulic power clamping device, but also the adjusting ring can be accommodated in its cross-section, thereby further reducing the amount of space required and simplifying the arrangement. The power clamping device and the adjusting ring can then act parallel to one another on one and the same ring adjacent to the ring fixed to the shaft, preferably even on the same end face of this ring.

Since the device according to the invention makes it possible to transmit unusually high axial forces, it is especially suitable for those arrangements in which the clamping of the roll ring or roll rings is carried out essentially axially only.

BRIEF DESCRIPTION OF THE DRAWING

The invention is explained in detail below with reference to the drawing illustrating an advantageous exemplary embodiment in a FIGURE, of which one half shows a longitudinal section and the other half a side view.

DESCRIPTION OF THE PREFERRED EMBODIMENT

The shaft 1 forms or carries a collar 2 which is integral with the shaft and which, on one side, forms the abutment for the roll-ring clamping. The roll rings 3, together with intermediate rings 4, are drawn onto the shaft 1 and centered either directly on the shaft's circumference or by further means not shown.

On the far side of its portion carrying the roll rings 3, the shaft is equipped with a thread 5, on which is arranged a nut 6 which, in relation to the invention, is designated as a support ring, fixed to the shaft, of the adjustable ring stop, because it is not adjusted according to the hydraulic pre-stress.

The nut 6 contains an annular piston 7 which can be subjected to a hydraulic medium via lines 8. Furthermore, the nut 6 contains, on the outside and on its end face confronting the roll-ring arrangement, a recess 9 in which the adjusting ring 10 is located. Both the hydraulic power clamping device and the adjusting ring are therefore accommodated in a space-saving way in the longitudinal-section area of the nut 6. Moreover, the form of the participating elements, especially also of the adjacent intermediate ring 4, on which the power clamping device and the adjusting ring act, is very simple.

As can be seen in the lower half of the FIGURE, the interacting end faces 11 of the nut 6 and of the adjusting ring 10 are made sawtooth-shaped with a very small flank inclination. The nut 6 is first tightened until only a slight axial compression of the roll-ring arrangement 3, 4 is still to be expected when the power clamping device is activated. Then, as a result of a slight rotation of the adjusting ring 10, the clamping state brought about by the power clamping device can be fixed axially, without the interacting portion of the sawtooth flanks being reduced appreciably. The pitch of these flanks in relation to the circumferential direction is well below the self-locking limit. Because these flanks have as large a surface as desired, it is possible for axial forces of any amount to be transmitted uniformly over the circumference.

I claim:

1. A roll device comprising:

a shaft having a longitudinal axis;

at least one roll ring arranged on the shaft;

a collar integral with the shaft and located on one axial side of the roll ring;

a ring stop located on the other axial side of the roll ring, the ring stop being axially adjustable and lockable on the shaft and intended for clamping the roll ring against the collar;

power clamping means for pre-stressing the roll ring toward the collar before the ring stop is adjusted to the clamping position against the roll ring;

wherein the adjustable ring stop includes a support ring (6) axially secured to the shaft and defining a first end face, and an adjusting ring (10) defining a second end face which interacts with the first end face, the end faces (11) having matching sloping flanks distributed as sawtooth-shaped segments over the circumferential extent of the faces, the flanks having a small pitch in relation to the circumferential direction along the faces.

2. The roll device of claim 1, wherein the power clamping means (7) is hydraulic and is contained in the support ring (6).

3. The roll device of claim 2, wherein the adjusting ring (10) and the power clamping means (7) act on one and the same ring (4) adjacent to the support ring (6).

4. The roll device of claim 3, wherein the power clamping means and the support ring clamp the roll ring essentially only axially.

5. The roll device of claim 2, wherein the power clamping means and the support ring clamp the roll ring essentially only axially.

6. The roll device of claim 1, wherein the power clamping means and the support ring clamp the roll ring essentially only axially.

* * * * *